US007169527B2

(12) United States Patent
Ito et al.

(10) Patent No.: US 7,169,527 B2
(45) Date of Patent: Jan. 30, 2007

(54) DEVELOPING AGENT AND METHOD FOR MANUFACTURING THE SAME

(75) Inventors: Tsuyoshi Ito, Shizuoka-ken (JP); Toshiaki Yamauchi, Fujisawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 313 days.

(21) Appl. No.: 10/805,513

(22) Filed: Mar. 22, 2004

(65) Prior Publication Data

US 2005/0208413 A1 Sep. 22, 2005

(51) Int. Cl.
*G03G 9/093* (2006.01)

(52) U.S. Cl. ..... 430/110.2; 430/137.14; 430/137.11

(58) Field of Classification Search ..... 430/110.2, 430/110.1, 137.14, 137.11
See application file for complete search history.

(56) References Cited

U.S. PATENT DOCUMENTS

| | | | | |
|---|---|---|---|---|
| 4,996,127 | A | 2/1991 | Hasegawa et al. | |
| 5,849,456 | A * | 12/1998 | Matsumura et al. | 430/126 |
| 2002/0160289 | A1* | 10/2002 | Teshima et al. | 430/108.1 |
| 2005/0069801 | A1* | 3/2005 | Yamasaki et al. | 430/110.2 |

FOREIGN PATENT DOCUMENTS

| | | | |
|---|---|---|---|
| JP | 2547014 | B2 | 8/1998 |
| JP | 3115032 | B2 | 9/2000 |
| JP | 3141783 | B2 | 12/2000 |

* cited by examiner

*Primary Examiner*—John L Goodrow
(74) *Attorney, Agent, or Firm*—Foley & Lardner LLP

(57) ABSTRACT

A developing agent includes a toner particle having a plurality of resin particles containing a binder resin and coloring agent, and a continuous releasant phase which is present between the plurality of resin particles, and coats the plurality of resin particles.

20 Claims, 3 Drawing Sheets

DEVELOPING AGENT AND METHOD FOR MANUFACTURING THE SAME

BACKGROUND OF THE INVENTION

The present invention relates to a developing agent used in image formation performed by an electrophotographic method or electrostatic recording method, and a method for manufacturing the same.

Conventionally, toner used in image formation performed by an electrophotographic method is generally manufactured by a kneading pulverization method. Examples of the demands for the toner are a small particle diameter for improving the image quality, and improved low-temperature fixing properties for energy saving. Recently, however, these demands are more and more increasing, so it becomes difficult for the conventional kneading pulverization method to meet these requirements. As new toner manufacturing techniques which replace the kneading pulverization method, wet manufacturing methods, for example, are attracting attention. A typical method is an aggregation method described in, e.g., Jpn. Pat. Appln. KOKAI Publication Nos. 63-282749 and 5-11501. This aggregation method includes dispersing a toner component as submicron-order particles in water, aggregating the particles by, e.g., the addition of an aggregating agent or a salt and allowing the aggregated particles to grow to a particle diameter suitable as toner, and fusing the aggregated particles by heating. When this method is used, the particle diameter of toner particles obtained by the control of the state of aggregation can be decreased. It is also possible to control the shape by the control of heating during fusion.

Also, as described in, e.g., Jpn. Pat. Appln. KOKAI Publication No. 10-26842, capsulated toner particles are obtained by using the particles obtained by the above aggregation method as cores, and coating the core surfaces with a resin to form shells. When this method is used, it is possible to prevent the conventional problem, i.e., the exposure of a releasant or coloring agent to the toner surface, and improve the durability of toner, carrier, and a photoreceptor.

Unfortunately, even when the aggregation method and capsulation described above are performed, no toner having low-temperature fixing properties which achieve energy saving and high speed has been obtained yet.

In addition, the capsulation technique has the problem that the durability of an image itself deteriorates if a material which easily melts is used as the core and a material which hardly melts is used as the shell.

BRIEF SUMMARY OF THE INVENTION

The present invention has been made in consideration of the above situation, and has as its first object to provide a developing agent which has excellent low-temperature fixing properties, and can achieve energy saving and high speed during image formation, and by which high-quality images are obtained.

It is the second object of the present invention to provide a method of forming a developing agent which has excellent low-temperature fixing properties, and can achieve energy saving and high speed during image formation, and by which high-quality images are obtained.

A developing agent of the present invention comprises a toner particle having a plurality of resin particles containing a binder resin and coloring agent, and a continuous-releasant phase which is present between the plurality of resin particles, and coats the plurality of resin particles.

A developing agent manufacturing method of the present invention comprises i) a secondary particle formation of forming secondary particles by adhering releasant particles to surfaces of primary particles which carry a coloring agent and contain a binder resin, ii) an aggregation of aggregating the secondary particles obtained in the secondary particle formation, and iii) a toner particle formation of heating an aggregate obtained in the aggregation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the embodiments given below, serve to explain the principles of the invention.

DETAILED DESCRIPTION OF THE INVENTION

Possible factors which contribute to fixing properties are the cohesive force inside a toner particle when the particle is heated and pressed in a fixing device, the cohesive force between toner particles, the releasability between a fixing member and toner, and the adhesion between toner and a recording medium. The present inventors particularly noted the releasability between a fixing member and toner and the adhesion between toner and a recording medium, and improved the dispersion state of a releasant in a developing agent. Consequently, the present inventors have found that the releasability and adhesion can be improved, and achieved the present invention.

A developing agent according to the present invention comprises a toner particle having a plurality of resin particles containing a binder resin and coloring agent, and a continuous releasant phase which is present between the plurality of resin particles, and coats the plurality of resin particles.

This developing agent can be manufactured by, e.g., the following manufacturing method.

A developing agent manufacturing method of the present invention comprises i) a secondary particle formation step of forming secondary particles by adhering releasant particles to surfaces of primary particles which carry a coloring agent and contain a binder resin, ii) an aggregation step of aggregating the secondary particles obtained in the secondary particle formation step, and iii) a toner particle formation step of heating an aggregate obtained in the aggregation step.

Figure 1:
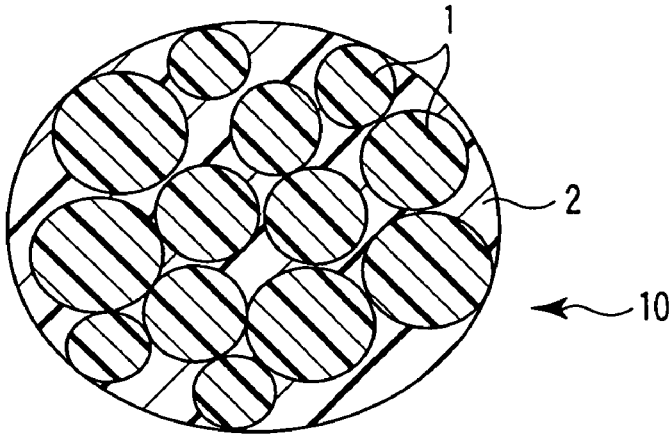
FIG. 1 is a model view showing an example of a toner particle used in the present invention.

FIG. 1 is a model view showing an example of a toner particle used in the present invention.

As shown in FIG. 1, a toner particle 10 has a disperse phase 1 containing a coloring agent and binder resin and obtained from the primary particles described above, and a continuous phase 2 obtained from a releasant applied to the surfaces of the primary particles, and present between dispersoids of the disperse phase 1.

This toner particle can be used as toner either singly or by mixing various additives as needed. Also, the toner can be used as a developing agent either singly or by mixing carrier as needed.

In a developing agent obtained by the conventional aggregation method, a releasant is mixed in primary particles, so it takes a long time for this releasant to ooze out to the surfaces of toner particles. In contrast, in the developing agent obtained by the present invention, a releasant is applied to the surfaces of the primary particles. Therefore, when the toner particle 10 is heated and pressed during fixing, an enough amount of releasant rapidly and easily oozes out from the continuous phase 2 of the toner particle 10, and at the same time the binder resin and coloring agent contained in the disperse phase 1 readily disperse. This accelerates penetration and strong adhesion of the releasant to a printing medium such as a paper sheet, and also accelerates adhesion of the binder resin and coloring agent. Since the low-temperature fixing properties thus improve, the fixing speed can be increased. The image quality also improves because a toner layer of an image is thin and uniform. Additionally, release from a fixing member by the releasant is also accelerated. Furthermore, in the developing agent obtained by the present invention, the continuous phase 2 well spreads between dispersoids 3 of the disperse phase 1, so the releasant component is well contained in the toner particle 10. This increases the storage stability and offset resistance.

As described above, the developing agent according to the present invention allows an enough amount of releasant to readily ooze out during fixing, without lowering the storage stability and offset resistance. Since the low-temperature fixing properties improve, high-speed fixing can be performed, and high-quality images are obtained.

The individual steps of the developing agent manufacturing method of the present invention will be described in more detail below.

Formation of Primary Particles in Step i)

In the present invention, a primary particle carries a coloring agent and contains a binder resin.

The coloring agent is carried by at least one of the interior and surface of the primary particle.

In step i), the primary particles can be formed by polymerizing a polymerizable material containing the coloring agent, by melting, kneading, and pulverizing a toner particle material containing the coloring agent, by polymerizing a polymerizable material and then applying the coloring agent, or by melting, kneading, and pulverizing a toner particle material containing no coloring agent and then applying the coloring agent.

Figure 2:
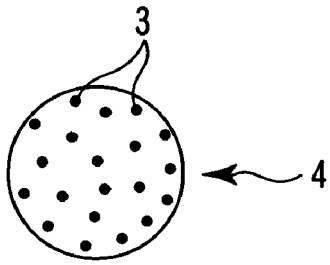
FIG. 2 is a model view showing an example of a primary particle used in the present invention.
Figure 3:
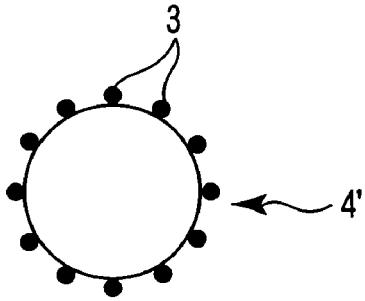
FIG. 3 is a model view showing an example of a primary particle used in the present invention.
Figure 4:
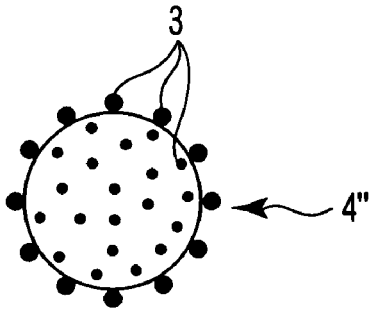
FIG. 4 is a model view showing an example of a primary particle used in the present invention.

FIGS. 2 to 4 are model views showing examples of the primary particle used in the present invention.

FIG. 2 shows a primary particle 4 which carries a coloring agent 3 in the interior.

FIG. 3 shows a primary particle 4' to the surface of which the coloring agent 3 is adhered.

FIG. 4 shows a primary particle 4" which carries the coloring agent 3 in the interior and on the surface.

To carry the coloring agent in the interior of the primary particle, the primary particles can be formed by forming resin particles from a polymerizable material such as a polymerizable monomer, oligomer, or prepolymer for forming a desired binder resin by emulsion polymerization, soap-free polymerization, seed polymerization, mini-emulsion polymerization, or the like, and then aggregating the resin particles together with coloring agent particles and the like. In this method, the surfaces of the primary particles can be fused by heating. The primary particles can also be formed by dissolving the binder resin together with the coloring agent and the like in a solvent, emulsifying the solution in a solvent medium, and removing the solvent. It is also possible to form the primary particles by using a polymerization method in the presence of the coloring agent, e.g., by polymerizing a polymerizable material such as a polymerizable monomer, oligomer, or prepolymer for forming a desired binder resin by, e.g., emulsion polymerization, soap-free polymerization, seed polymerization, mini-emulsion polymerization, or suspension polymerization. Furthermore, the primary particles can be formed by a pulverization method, e.g., by melting and kneading a binder resin together with the coloring agent, and mechanically emulsifying and pulverizing the kneaded product by a wet method.

To carry the coloring agent on the surface, resin particles are formed without using the coloring agent during the formation of the primary particles described above. The coloring agent can be adhered by, e.g., adjusting the pH of the surfaces of the obtained resin particles, heating the surfaces, adding a salt to the surfaces, or adding an aggregating agent to the surfaces. Alternatively, the coloring agent can also be adhered to the surfaces of the primary particles described above.

The volume-average particle diameter of the primary particles is preferably 3 to 0.1 μm, and more preferably, 1 to 0.3 μm. If the volume-average particle diameter exceeds 3 μm, the finally obtained toner particle size distribution tends to broaden. If the volume-average particle diameter is smaller than 0.1 μm, it tends to become difficult to cause the primary particles to contain the coloring agent.

In step i), the secondary particles to which the releasant particles are adhered can be further heated.

In step ii), the aggregated secondary particles are heated, and a coating resin material is applied to the heated secondary particles. In this manner, an aggregate coated with the coating resin material can be obtained.

Alternatively, in step ii), an aggregate coated with a coating resin material can be obtained by applying the coating resin material without heating the aggregated secondary particles.

The binder resin and coating resin can contain the same resin component or different resin components.

Figure 5:
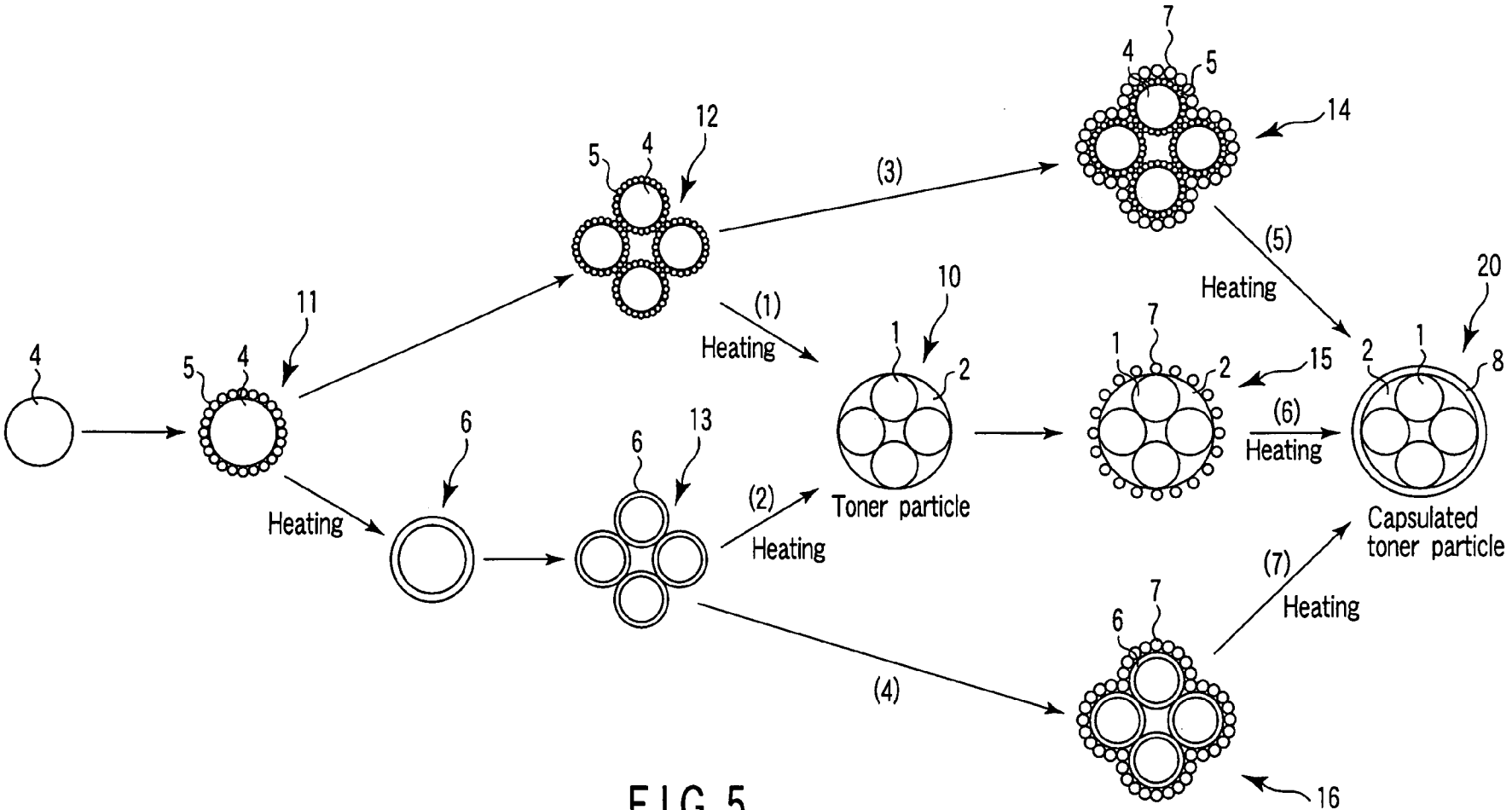
FIG. 5 is a model view for explaining steps of forming the toner particle used in the present invention.

FIG. 5 is a model view for explaining steps of forming the toner particle of the present invention by using the primary particles described above.

For the sake of simplicity, the primary particles 4, 4', and 4" described above will be collectively referred to as primary particles 4 hereinafter.

Step i) Secondary Particle Formation Step

In the present invention, as shown in FIG. 5, a secondary particle 11 is obtained by adhering a releasant 5 to the surface of the primary particle 4.

The releasant particles can be obtained by dispersing a releasant, which is coarsely pulverized beforehand, in a solvent medium by using a dispersant such as a surfactant, and pulverizing or emulsifying the dispersion by using a homogenizer, beads mill, or high-pressure impingement type emulsifier. If the temperature of the solvent medium is higher than the melting point of the releasant, particles having a small particle diameter and a narrow particle size distribution can be easily formed.

The particle diameter of the releasant particles is preferably smaller than that of the primary particles. If the releasant particles are larger than the primary particles, it tends to become difficult to evenly adhere the releasant particles to each primary particle.

As shown in FIG. 5, after the releasant particles 5 are adhered to the primary particles 4, the solvent medium is heated to a temperature higher than the melting point of the releasant particles 5 in a solution containing the obtained secondary particles. In this manner, releasant-coated secondary particles 6 can be formed by coating the surfaces of the primary particles with the releasant layer. However, this step can be omitted if heating is well performed in subsequent step iii).

The addition amount of releasant is preferably 5 to 30 wt %, and more preferably, 10 to 20 wt % of the total toner particle weight. If the addition amount is less than 5%, it tends to become difficult to obtain a phase separation structure. If the addition amount exceeds 30%, the mechanical strength of the toner tends to lower.

When No Capsulation Is Performed

Aggregate Formation in Step ii)

An aggregate 12 or 13 can be obtained by adjusting a solution containing the secondary particles 4 or releasant-coated secondary particles 6 by, e.g., pH adjustment, heating, the addition of a salt, or the addition of an aggregating agent, thereby reducing or eliminating the repulsive force between the secondary particles. Consequently, the particle diameter of the aggregate can be increased to a particle diameter necessary as toner. The obtained aggregate 12 or 13 of the secondary particles can undergo step iii) described below.

Toner Particle Formation in Step iii)

As indicated by route (1) or (2) in FIG. 5, a toner particle 10 is obtained by heating the aggregate 12 or 13 finally obtained in step ii) to a temperature higher than Tg of the binder resin or the melting temperature of the releasant, thereby fusing the aggregate 12 or 13.

When Capsulation is Performed

Aggregate Formation in Step ii)

Secondary Particle Aggregation Step

An aggregate 12 or 13 can be obtained by preparing a solution containing the secondary particles 4 or releasant-coated secondary particles 6 by, e.g., pH adjustment, heating, the addition of a salt, or the addition of an aggregating agent, thereby reducing or eliminating the repulsive force between the secondary particles. Consequently, the particle diameter of the aggregate can be increased to a particle diameter necessary as toner.

Coating Resin Material Application Step

As the coating resin material, resin particles can be preferably used.

The diameter of the resin particles is preferably 0.01 to 1 μm, and more preferably, 0.05 to 0.5 μm. If the particle diameter is less than 0.01 μm, the durability of the toner tends to lower. If the particle diameter exceeds 1 μm, the particle size distribution of the toner tends to broaden.

When capsulation is to be performed, a solution containing the aggregate 12 or 13 of the secondary particles is prepared, and, similar to the formation of toner particles when no capsulation is performed, as indicated by route (1) or (2) in FIG. 5, the aggregate in the solution can be heated and fused before resin particles are applied. After that, resin particles 7 are applied to obtain a toner particle 15 to which the resin particles 7 are adhered. The toner particle 15 to which the resin particles are thus adhered will be referred to as "an aggregate obtained in step ii)" hereinafter.

Alternatively, as indicated by route (3) or (4) in FIG. 5, an aggregate 14 or 16 to which the resin particles 7 are adhered is obtained by applying the resin particles 7 without any heating or fusion. The aggregates 14 and 16 to which the resin particles are thus adhered will be referred to as "aggregates obtained in step ii)" hereinafter.

As a method of applying the coating resin material, it is possible to prepare a solution containing the aggregate of the secondary particles, apply resin particles and the like to the solution, and adjust the solution by, e.g., pH adjustment, heating, the addition of a salt, or the addition of a releasant, thereby adhering the particles of the coating resin material and the like to the surface of the aggregate.

As another method of applying the coating resin material it is possible to add a polymerizable material such as a polymerizable monomer to a solution containing the aggregate, thereby coating the surfaces of the aggregate particles with the polymerizable material, and then polymerize the polymerizable material.

As still another method of applying the coating resin material, it is possible to fuse the aggregate as described above, wash and dry the fused aggregate, and mechanically adhere resin particles and the like to the surface of the aggregate by using a hybridizer or the like.

Tg of the coating resin material used is preferably 50° C. to 100° C., and more preferably, 55° C. to 80° C. If Tg is less than 50° C., the storage stability of the toner tends to worsen. If Tg exceeds 80° C., the fixing properties of the toner tends to worsen.

Capsulated Toner Particle Formation in Step iii)

As indicated by route (5), (6), or (7) in FIG. 5, a capsulated toner particle 20 is obtained by heating the aggregate 14, 15, or 16 finally obtained in step ii) to a temperature higher than Tg of the binder resin or the melting point of the releasant, thereby fusing the aggregate 14, 15, or 16.

Examples of the polymerizable material are aromatic vinyl monomers such as styrene, methylstyrene, methoxystyrene, phenylstyrene, and chlorostyrene; ester-based monomers such as methyl acrylate, ethyl acrylate, butyl acrylate, methyl methacrylate, ethyl methacrylate, and butyl methacrylate; carboxylic acid-containing monomers such as acrylic acid, methacrylic acid, fumaric acid, and maleic acid; amine-based monomers such as aminoacrylate, acrylamide, methacrylamide, vinylpyridine, and vinylpyrrolidone; and derivatives of these monomers. These polymerizable materials can be used singly or combined.

As a chain transfer agent, it is possible to use, e.g., carbon tetrabromide, dodecylmercaptane, trichlorobromomethane, or dodecanethiol.

As a crosslinking agent, a compound having two or more unsaturated bonds can be used. Examples are divinylbenzene, divinylether, divinylnaphthalene, and diethyleneglycol methacrylate.

A polymerization initiator to be used depends on an applied polymerization method. Examples are a water-soluble initiator and oil-soluble initiator. Examples of the water-soluble initiator are persulfates such as potassium persulfate and ammonium persulfate; azo-based compounds such as 2,2-azobis(2-aminopropane); hydrogen peroxide; and benzoyl peroxide. Examples of the oil-soluble initiator are azo-based compounds such as azobisisobutylnitrile and azobisdimethylvaleronitrile; and peroxides such as benzoyl peroxide, and dichlorobenzoyl peroxide. If necessary, a redox-based initiator may also be used.

As the dispersant, it is possible to use, e.g., an anionic surfactant, cationic surfactant, or nonionic surfactant. Examples of the anionic surfactant are sulfuric ester, sulfonate, and phosphoric ester, examples of the cationic surfactant are an amine salt and quaternary ammonium salt, and examples of the nonionic surfactant are polyethyleneglycols, an alkylphenolethyleneoxide adduct, and polyvalent alcohols. These surfactants can be used singly or combined.

As the aggregating agent, it is possible to use a polymeric aggregating agent such as polyacrylamide or an acrylamide derivative; an inorganic aggregating agent such as aluminum sulfate, polyaluminum hydroxide, or polyaluminum chloride; or a salt such as sodium chloride or magnesium chloride.

Examples of the binder resin and coating resin are a polyester resin, a polystyrene resin, a styrene-acrylate copolymer, an epoxy resin, and a mixture of several types of these materials.

As the binder resin and coating resin, resins containing the same resin component or different resin components can be used. Even when these resins contain the same resin component, the physical properties such as the softening point and molecular weight can be appropriately selected as needed. "Containing the same resin component" means that, e.g., the same polymerizable material is used in polymerization, or the same repeating unit is used.

As the coloring agent, it is possible to use, e.g., carbon black or an organic or inorganic pigment or dye. Examples of the carbon black are acetylene black, furnace black, thermal black, channel black, and ketjen black. Examples of the pigment and dye are Fast Yellow G, Benzidine Yellow, Indo Fast Orange, Irgazine Red, Carmine FB, Carmine 6B, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green, quinacridone, and mixtures of these pigments and dyes.

Examples of the releasant are natural wax such as rice wax and carnauba wax; petroleum wax such as paraffin wax; and synthetic wax such as fatty acid ester, fatty acid amide, low-molecular-weight polyethylene, and low-molecular-weight polypropylene.

Furthermore, a charge controller, lubricant, fluidizer, solvent, and the like can also be added where necessary.

Figure 6:
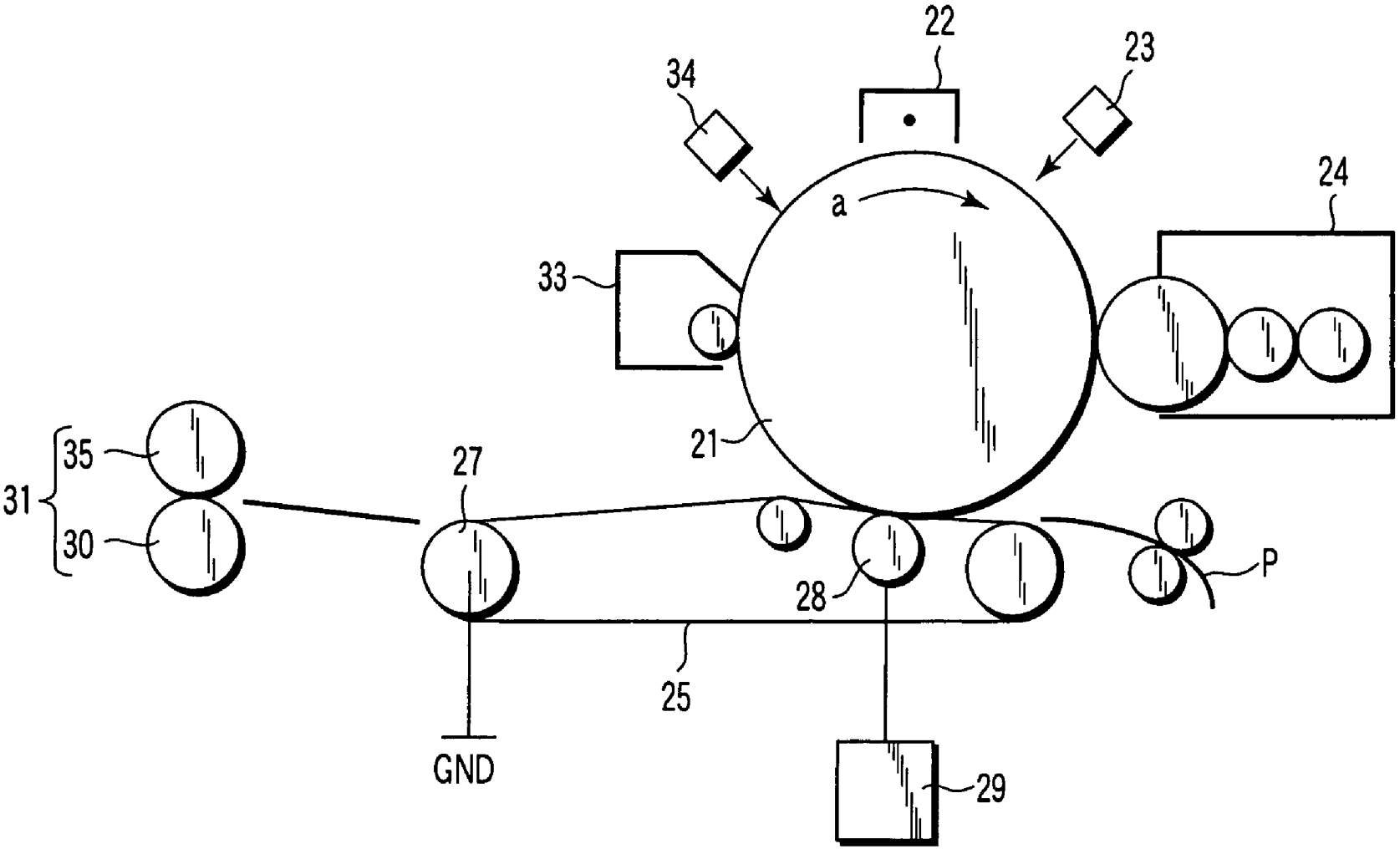
FIG. 6 is a schematic view showing an example of an image forming apparatus capable of using a developing agent according to the present invention.

FIG. 6 is a schematic view showing an example of an image forming apparatus capable of using the developing agent according to the present invention.

As shown in FIG. 6, a photoreceptor 21 rotatable in the direction indicated by an arrow a is evenly given a surface potential of −500 to 800 V by a charger 22. An electrostatic latent image is formed on the photoreceptor 21 by an exposure device 23. This electrostatic latent image is visualized by toner negatively charged by a developing device 24. On the downstream side of the developing device 24, a belt 25 is pushed against the photoreceptor 21, and a paper sheet P as a transfer medium is interposed between the belt 25 and photoreceptor 21. The toner image on the photoreceptor 21 is transferred onto the paper sheet P by a bias voltage of +300 V to 5 kV applied to the belt by a high-voltage power supply 29. The belt 25 is, e.g., an elastic belt having a volume resistance of $10^8$ to $10^{12}$ Ω·cm, and supported by a plurality of rollers. When driven by a roller 27 as one of these rollers, the belt 25 can rotate at substantially the same surface velocity as the photoreceptor 21. A conductive elastic roller 28 having a volume resistance of $10^2$ to $10^8$ Ω·cm is used as a power supply member to supply power from the belt back surface in a region where the photoreceptor 21 and belt 25 are in contact with each other. In normal printing, the belt 25 and photoreceptor 21 are driven as they are separated from each other, and brought into contact with each other after the surface velocities of the two members become substantially equal. At the same time the transfer bias is applied to the power supply roller 28, the paper sheet P as a transfer medium is conveyed to a transfer nip region, and the toner image is formed on the paper sheet P. The paper sheet P passing through the transfer nip between the photoreceptor 21 and power supply roller 28 is electrostatically attracted to the belt 25. However, since the curvature of the driving roller 27 of the belt 25 is large, the leading edge of the paper sheet P is separated from the belt on the most downstream side of the belt unit. In this manner, the paper sheet P can be conveyed to a fixing device 31 via a guide member.

On the downstream side of the transfer nip, extra toner is removed by a cleaning means 33, and the electric charge is removed by a charge removing means 34.

In the fixing device 31, an image is formed by performing fixing at a fixing temperature of, e.g., 160 to 190° C. by a heat roller 35 and press roller 30.

EXAMPLES

The present invention will be described in more detail below by way of its examples.

The particle diameters were measured using SALD-7000 manufactured by Shimadzu. An outline of each toner manufactured by way of trial is shown in Table 1.

Example 1

Formation of Primary Particles

| Binder Resin Material Composition | |
|---|---|
| Styrene | 320 g |
| Butyl acrylate | 56 g |
| Acrylic acid | 8 g |
| Dodecanethiol | 12 g |
| Carbon tetrabromide | 4 g |

The materials having the above composition were mixed, and the mixture was dispersed and emulsified in a solvent medium prepared by dissolving 6 g of a nonionic surfactant (SANYO CHEMICAL) and 10 g of an anionic surfactant (Dai-ichi Kogyo Seiyaku) in 550 g of ion exchange water. In addition, 10 g of an 8% ammonium persulfate solution were gradually added to perform nitrogen replacement. After that, emulsion polymerization was performed at 70° C. for 5 hrs to obtain a resin particle dispersion having a volume-average particle diameter of 105 nm, a glass transition point Tg of 60° C., and a weight-average molecular weight Mw of 12,000.

| Coloring agent Dispersion Composition | |
|---|---|
| Carbon black (CABOT) | 100 g |
| Anionic surfactant (Dai-ichi Kogyo Seiyaku) | 10 g |
| Ion exchange water | 390 g |

The materials having the above composition were dispersed using a homogenizer (IKA) to form a coloring agent dispersion having a volume-average particle diameter of 150 nm.

The obtained resin particle dispersion and coloring agent dispersion were mixed by the following mixing amounts, and the mixture was evenly dispersed using the homogenizer (IKA).

| | |
|---|---|
| Resin particle dispersion (resin particle content 170 g) | 426 g |
| Coloring agent dispersion (coloring agent content 16 g) | 64 g |

After that, 10 g of ion exchange water containing 10 wt % of polyaluminum chloride (Central Glass) were added, and the resultant material was held at 65° C. for 1 hr under weak stirring. As a consequence, a dispersion containing coloring agent-containing resin particles having a volume-average particle diameter of 610 nm was obtained.

Formation of Secondary Particles

| Releasant Particle Dispersion Composition | |
|---|---|
| Rice wax (melting point 80° C., TOA KASEI) | 100 g |
| Cationic surfactant (Kao) | 10 g |
| Ion exchange water | 390 g |

The materials having the above composition were dispersed at about 90° C. by using the homogenizer (IKA). After that, a wet-type high-pressure emulsifier was used to form a releasant particle dispersion having a volume-average particle diameter of 102 nm.

The obtained releasant dispersion and the coloring agent-containing resin particle dispersion described above were mixed by the following mixing amounts, and the mixture was evenly dispersed using the homogenizer (IKA) and held at room temperature for 1 hr.

| | |
|---|---|
| Coloring agent-containing resin particle dispersion | 369 g |
| Releasant particle dispersion | 121 g |

After that, the resultant material was held at 85° C. for 30 min under weak stirring. As a consequence, a dispersion containing secondary particles having a volume-average particle diameter of 640 nm was obtained. When the section of this secondary particle was observed with a transmission electron microscope, the surface of the secondary particle was coated with a releasant layer about 40 nm thick.

Formation of Aggregated Particles 10 g of ion exchange water containing polyaluminum chloride (Central Glass) were added to the secondary particle dispersion described above, and the resultant material was held at 50° C. for 1 hr and 65° C. for 3 hrs under weak stirring. Consequently, a dispersion containing aggregated particles having a volume-average particle size of 5.1 μm was obtained.

Formation of Fused Particles

The aggregated particle dispersion described above was held at 85° C. for 30 min under weak stirring, thereby fusing the aggregated particles.

Formation of Toner Particles

The dispersion containing the fused particles described above was filtered and repetitively washed with ion exchange water and filtered, and the water was then well removed by filtering. After that, the resultant material was dried in a vacuum dryer for 10 hrs to obtain toner particles having a volume-average particle diameter of 5.1 μm. When the section of this toner particle was observed with the transmission electron microscope, a phase separation structure having the releasant as a continuous phase and the coloring agent-containing particles as a disperse phase as shown in FIG. 1 was found.

Table 1 below shows the arrangement of the continuous phase, the presence/absence of the capsulation step, the binder resin composition, the releasant addition amount, the releasant particle diameter, and the toner particle diameter of the obtained toner particles.

Formation of Toner 3 parts by weight of silica (Nippon Aerosil) having an average particle size of 0.2 μm and 0.5 parts by weight of titanium oxide (ISHIHARA SANGYO KAISHA) having an average particle diameter of 0.1 μm were added to 100 parts by weight of the toner particles described above. These materials were mixed and adhered by a Henschel mixer (MITSUI MINING) to obtain toner having a releasant content of 15%.

Fixing Property Test

A remodeled machine of the FC-22 full-color copying machine manufactured by TOSHIBA TEC was used to set the developing conditions such that the toner adhesion amount to a paper sheet was 1.0 mg/cm$^2$. While the fixing temperatures of the upper and lower rollers were changed, a monochrome solid chart was output at a roller speed of 125 mm/sec and a nip width of 9 mm. The fixing properties were evaluated by checking the temperature range of a non-offset region. The paper sheets used were 80 g of plain paper sheets. The obtained results are shown in Table 2 below.

Durability Test

The above copying machine was used to set the conditions such that a predetermined amount of toner was always adhered to a paper sheet, and a continuous sheet feeding durability test was conducted by printing a chart having a printing ratio of 8% on 50,000 sheets. In this test, a full solid image was output every 5,000 sheets to check the presence/absence of an image defect by filming, and the number of sheets when an image defect occurred. The results are shown in Table 2 below.

Pulverizing Property Test

The developing agent was taken out of the machine after 50,000 sheets were printed, and the number-average particle diameter of the toner was measured. The pulverizing properties of the toner were evaluated by comparing the measured particle diameter with the particle diameter before the test. If the number-average particle size decreases, this means that the amount of fine particles increases, so the pulverizing properties are confirmed. The results are shown in Table 2 below.

Comparative Example 1

Following the same procedures as in Example 1, a resin particle dispersion and coloring agent dispersion were prepared.

Formation of Releasant Particle Dispersion

| | |
|---|---|
| Rice wax (melting point 80° C., TOA KASEI) | 100 g |
| Anionic surfactant (Kao) | 10 g |
| Ion exchange water | 390 g |

The above materials were dispersed at about 90° C. by using a homogenizer (IKA). After that, a wet-type high-pressure emulsifier was used to emulsify the dispersion by setting the processing pressure at 160 MPa, thereby forming a releasant particle dispersion having a volume-average particle diameter of 102 nm.

Formation of Aggregated Particles

The resin particle dispersion, coloring agent particle dispersion, and releasant particle dispersion were evenly dispersed by the following mixing amounts by using the homogenizer (IKA).

| | |
|---|---|
| Resin particle dispersion | 313 g |
| Coloring agent dispersion | 56 g |
| Releasant particle dispersion | 120 g |

After that, 10 g of ion exchange water containing polyaluminum chloride (Central Glass) were added, and the resultant material was held at 50° C. for 1 hr under weak stirring. As a consequence, a dispersion containing aggregated particles having a volume-average particle diameter of 5.0 μm was obtained.

Formation of Fused Particles

The aggregated particle dispersion described above was held at 65° C. for 5 hrs to fuse the aggregated particles.

Formation of Toner Particles

The dispersion containing the fused particles described above was filtered and repetitively washed with ion exchange water and filtered, and the water of the particles was then well removed by filtering. After that, the resultant material was dried in a vacuum dryer for 10 hrs to obtain toner particles having a volume-average particle diameter of 5.0 μm. When the section of this toner particle was observed with a transmission electron microscope, the releasant dispersed at random in the binder resin.

Table 1 below shows the arrangement of the continuous phase, the presence/absence of the capsulation step, the binder resin composition, the releasant addition amount, the releasant particle diameter, and the toner particle diameter of the obtained toner particles.

Formation of Toner

Additives were added to 100 parts by weight of the toner particles described above following the same procedures as in Example 1, thereby obtaining toner having a releasant content of 15%.

The fixing property test, durability test, and pulverizing property test were conducted on the obtained toner in the same manner as in Example 1. The obtained results are shown in Table 2 below.

Example 2

Following the same procedures as in Example 1, a dispersion containing aggregated particles was obtained.

Formation of Capsulated Toner Particles

Materials having the following composition were mixed, and the mixture was dispersed and emulsified in a solvent medium prepared by dissolving 6 g of a nonionic surfactant (SANYO CHEMICAL) and 10 g of an anionic surfactant (Dai-ichi Kogyo Seiyaku) in 550 g of ion exchange water.

| Coating Resin Composition | |
|---|---|
| Styrene | 320 g |
| Butyl acrylate | 56 g |
| Acrylic acid | 8 g |
| Dodecanethiol | 12 g |
| Carbon tetrabromide | 4 g |

After that, 10 g of an 8% ammonium persulfate solution were gradually added to perform nitrogen replacement. Emulsion polymerization was then performed at 70° C. for 5 hrs to obtain a coating resin particle dispersion having a volume-average particle diameter of 105 nm, a Tg of 60° C., and an Mw of 12,000.

The above aggregated particle dispersion and coating resin particle dispersion were mixed by the following mixing ratio.

| | |
|---|---|
| Aggregated particle dispersion | 455 g |
| Resin particle dispersion | 45 g |

The mixture was held at 65° C. and a stirring speed of 300 rpm for 5 hrs to adhere and fuse the coating resin particles to the surfaces of the aggregated particles, thereby obtaining a dispersion containing fused particles having a volume-average particle diameter of 5.3 μm.

The dispersion containing the fused particles described above was filtered and repetitively washed with ion exchange water and filtered, and the water of the particles was then well removed by filtering. After that, the resultant material was dried in a vacuum dryer for 10 hrs to obtain capsulated toner particles having a volume-average particle diameter of 5.3 μm. When the section of this capsulated toner particle was observed with a transmission electron microscope, the particle had a region having a phase separation structure including a continuous phase substantially made of the releasant and a disperse phase containing the binder resin ad coloring agent, and a coating resin layer formed on the surface of the region, as indicated by the capsulated toner particle 20 shown in FIG. 5.

Table 1 below shows the arrangement of the continuous phase, the presence/absence of the capsulation step, the binder resin composition, the releasant addition amount, the releasant particle diameter, and the toner particle diameter of the obtained toner particles.

Formation of Toner 3 parts by weight of the same silica (Nippon Aerosil) and 0.5 parts by weight of the same titanium oxide (ISHIHARA SANGYO KAISHA) as used in Example 1 were added to 100 parts by weight of the capsulated toner particles described above. These materials were mixed and adhered by a Henschel mixer (MITSUI MINING) to obtain capsulated toner having a releasant content of 13%.

The fixing property test, durability test, and pulverizing property test were conducted on the obtained toner in the same manner as in Example 1. The obtained results are shown in Table 2 below.

Comparative Example 2

Capsulated toner was obtained following the same procedures as in Example 2 except that the same dispersion containing aggregated particles as used in Comparative Example 1 was used.

Table 1 below shows the arrangement of the continuous phase, the presence/absence of the capsulation step, the binder resin composition, the releasant addition amount, the releasant particle diameter, and the toner particle diameter of the obtained toner particles.

The fixing property test, durability test, and pulverizing property test were conducted on the obtained toner in the same manner as in Example 1. The obtained results are shown in Table 2 below.

Example 3

Capsulated toner having a volume-average particle diameter of 5.3 μm and a releasant content of 22% was obtained following the same procedures as in Example 2 except that the mixing amounts of the coloring agent-containing resin particle dispersion and releasant particle dispersion in the secondary particle formation step were changed as follows,

| | |
|---|---|
| Coloring agent-containing resin particle dispersion | 240 g |
| Releasant particle dispersion | 80 g |

and that the mixing amounts of the aggregated particle dispersion and emulsified particle dispersion in the capsulated particle formation step were changed as follows.

| | |
|---|---|
| Aggregated particle dispersion | 458 g |
| Coated resin particle dispersion | 42 g |

Table 1 below shows the arrangement of the continuous phase, the presence/absence of the capsulation step, the binder resin composition, the releasant addition amount, the releasant particle diameter, and the toner particle diameter of the obtained toner particles.

The fixing property test, durability test, and pulverizing property test were conducted on the obtained toner in the same manner as in Example 1. The obtained results are shown in Table 2 below.

Comparative Example 3

An aggregated particle dispersion was obtained following the same procedures as in Comparative Example 1 except that the mixing amounts of the resin particle dispersion, coloring agent particle dispersion, and releasant particle dispersion in the aggregated particle formation step were changed as follows.

| | |
|---|---|
| Binder resin particle dispersion | 269 g |
| Coloring agent dispersion | 48 g |
| Releasant particle dispersion | 173 g |

Capsulated toner having a volume-average particle diameter of 5.2 μm and a releasant content of 22% was obtained following the same procedures as in Example 2 except that the above aggregated particle dispersion was used and the mixing amounts of the aggregated particle dispersion and coating resin particle dispersion were changed as follows.

| | |
|---|---|
| Aggregated particle dispersion | 458 g |
| Coating resin particle dispersion | 42 g |

Table 1 below shows the arrangement of the continuous phase, the presence/absence of the capsulation step, the binder resin composition, the releasant addition amount, the releasant particle diameter, and the toner particle diameter of the obtained toner particles.

The fixing property test, durability test, and pulverizing property test were conducted on the obtained toner in the same manner as in Example 1. The obtained-results are shown in Table 2 below.

Example 4

Formation of Primary Particles

| Coloring agent-Containing Resin Particle Composition | |
|---|---|
| Polyester resin (bisphenol A - terephthalic acid adduct; Tg = 61° C., Mw = 13,000) | 93 g |
| Carbon black (CABOT) | 7 g |
| Methylene chloride (Wako Pure Chemical) | 200 g |

The above materials were dissolved and dispersed in 357 g of ion exchange water containing 40 g of polyethylene glycol (Wako Pure Chemical) and 3 g of an anionic surfactant (Dai-ichi Kogyo Seiyaku), thereby forming an O/W emulsion dispersion by using a homogenizer (IKA). After that, the methylene chloride was removed by heating the dispersion to 60° C., thereby forming a coloring agent-containing resin particle dispersion having a volume-average particle diameter of 510 nm.

Formation of Secondary Particles

| Releasant Particle Dispersion Composition | |
|---|---|
| Rice wax (melting point 80° C., TOA KASEI) | 100 g |
| Cationic surfactant (Kao) | 10 g |
| Ion exchange water | 390 g |

The above materials were dispersed at about 90° C. by using the homogenizer (IKA). After that, a wet-type high-pressure emulsifier was used to form a releasant particle dispersion having a volume-average particle diameter of 98 nm.

The obtained releasant dispersion and the coloring agent-containing resin particle dispersion described above were mixed by the following mixing amounts, and the mixture was evenly dispersed using the homogenizer (IKA) and held at room temperature for 1 hr.

| | |
|---|---|
| Coloring agent-containing resin particle dispersion | 417 g |
| Releasant particle dispersion | 74 g |

After that, the resultant material was held at 85° C. for 30 min under weak stirring. As a consequence, a dispersion containing secondary particles having a volume-average particle diameter of 540 nm was obtained. When the section of this secondary particle was observed with a transmission electron microscope, the surface of the secondary particle was coated with a releasant layer about 30 nm thick.

Formation of Aggregated Particles 10 g of ion exchange water containing polyaluminum chloride (Central Glass) were added to the secondary particle dispersion described above, and the resultant material was held at 50° C. for 1 hr under weak stirring. Consequently, a dispersion containing aggregated particles having a volume-average particle size of 5.5 μm was obtained.

Formation of Capsulated Toner Particles

| Coating Resin Composition | |
|---|---|
| Styrene | 320 g |
| Butyl acrylate | 56 g |
| Acrylic acid | 8 g |
| Dodecanethiol | 12 g |
| Carbon tetrabromide | 4 g |

The materials having the above composition were mixed, and the mixture was dispersed and emulsified in a solvent medium prepared by dissolving 6 g of a nonionic surfactant (SANYO CHEMICAL) and 10 g of an anionic surfactant (Dai-ichi Kogyo Seiyaku) in 550 g of ion exchange water. In addition, 10 g of an 8% ammonium persulfate solution were gradually added to perform nitrogen replacement. After that, emulsion polymerization was performed at 70° C. for 5 hrs to obtain a coating resin particle dispersion having a volume-average particle diameter of 105 nm, a Tg of 60° C., and an Mw of 12,000.

The above aggregated particle dispersion and coating resin particle dispersion were mixed by the following mixing amounts.

| | |
|---|---|
| Aggregated particle dispersion | 473 g |
| Resin particle dispersion | 27 g |

The mixture was held at 65° C. and a stirring speed of 300 rpm for 5 hrs to obtain a dispersion containing fused particles having a volume-average particle diameter of 5.7 μm.

The dispersion containing the fused particles described above was filtered and repetitively washed with ion exchange water and filtered, and the water of the particles was then well removed by filtering. After that, the resultant material was dried in a vacuum dryer for 10 hrs to obtain capsulated toner particles having a volume-average particle diameter of 5.7 μm. When the section of this capsulated toner particle was observed with a transmission electron microscope, the particle had a region having a phase separation structure including a continuous phase substantially made of the releasant and a disperse phase containing the binder resin and coloring agent, and a coating resin layer coating the surface of the region, as indicated by the capsulated toner particle 20 shown in FIG. 5.

Table 1 below shows the arrangement of the continuous phase, the presence/absence of the capsulation step, the binder resin composition, the releasant addition amount, the releasant particle diameter, and the toner particle diameter of the obtained toner particles.

Formation of Toner 3 parts by weight of the same silica (Nippon Aerosil) and 0.5 parts by weight of the same titanium oxide (ISHIHARA SANGYO KAISHA) as used in Example 1 were added to 100 parts by weight of the capsulated toner particles described above. These materials were mixed and adhered by a Henschel mixer (MITSUI MINING) to obtain capsulated toner having a releasant content of 13.0%.

The fixing property test, durability test, and pulverizing property test were conducted on the obtained toner in the same manner as in Example 1. The obtained results are shown in Table 2 below.

Comparative Example 4

Formation of Resin Particles

| Resin Particle Composition | |
|---|---|
| Polyester resin (bisphenol A - terephthalic acid adduct, Tg = 61° C., Mw = 13,000) | 100 g |
| Methylene chloride (Wako Pure Chemical) | 200 g |

The above materials were dissolved and dispersed in 357 g of ion exchange water containing 40 g of polyethylene glycol (Wako Pure Chemical) and 3 g of an anionic surfactant (Dai-ichi Kogyo Seiyaku), thereby forming an O/W emulsion dispersion by using a homogenizer (IKA). After that, the methylene chloride was removed by heating the dispersion to 60° C., thereby forming a coloring agent-containing resin particle dispersion having a volume-average particle diameter of 500 nm.

Formation of Coloring Agent Dispersion

| Coloring agent Dispersion Composition | |
|---|---|
| Carbon black (CABOT) | 100 g |
| Anionic surfactant (Dai-ichi Kogyo Seiyaku) | 10 g |
| Ion exchange water | 390 g |

The above materials were dispersed using the homogenizer (IKA) to form a coloring agent dispersion having a volume-average particle diameter of 150 nm.

Formation of Releasant Particle Dispersion

| Releasant Particle Dispersion Composition | |
|---|---|
| Rice wax (melting point 80° C., TOA KASEI) | 100 g |
| Cationic surfactant (Kao) | 10 g |
| Ion exchange water | 390 g |

The above materials were dispersed at about 90° C. by using the homogenizer (IKA). After that, a wet-type high-pressure emulsifier was used to form a releasant particle dispersion having a volume-average particle diameter of 98 nm.

Formation of Aggregated Particles

| Aggregated Particle Dispersion Composition | |
|---|---|
| Resin particle dispersion | 382 g |
| Coloring agent dispersion | 34 g |
| Releasant particle dispersion | 73 g |

After the above materials were evenly dispersed using the homogenizer (IKA), 10 g of ion exchange water containing polyaluminum chloride (Central Glass) were added, and the resultant material was held at 50° C. for 1 hr under weak stirring. Consequently, a dispersion containing aggregated particles having a volume-average particle diameter of 5.5 μm was obtained.

Formation of Capsulated Toner Particles

| Coating Resin Composition | |
|---|---|
| Styrene | 320 g |
| Butyl acrylate | 56 g |
| Acrylic acid | 8 g |
| Dodecanethiol | 12 g |
| Carbon tetrabromide | 4 g |

The above materials were mixed, and the mixture was dispersed and emulsified in a solvent medium prepared by dissolving 6 g of a nonionic surfactant (SANYO CHEMICAL) and 10 g of an anionic surfactant (Dai-ichi Kogyo Seiyaku) in 550 g of ion exchange water. In addition, 10 g of an 8% ammonium persulfate solution were gradually added to perform nitrogen replacement. After that, emulsion polymerization was performed at 70° C. for 5 hrs to obtain a coating resin particle dispersion having a volume-average particle diameter of 105 nm, a Tg of 60° C., and an Mw of 12,000.

The above aggregated particle dispersion and coating resin particle dispersion were mixed by the following mixing amounts. The mixture was held at 65° C. and a stirring speed of 300 rpm for 5 hrs to obtain a dispersion containing fused particles having a volume-average particle diameter of 5.7 μm.

| | |
|---|---|
| Aggregated particle dispersion | 473 g |
| Resin particle dispersion | 27 g |

The fused particles described above were filtered and repetitively washed with ion exchange water and filtered, and the water of the fused particles was then well removed by filtering. After that, the resultant material was dried in a vacuum dryer for 10 hrs to obtain capsulated toner particles having a volume-average particle diameter of 5.7 μm. When the section of this capsulated toner particle was observed with a transmission electron microscope, the particle had an internal region in which the releasant dispersed at random in the binder resin, and a coating resin layer coating the surface of the region.

Table 1 below shows the arrangement of the continuous phase, the presence/absence of the capsulation step, the binder resin composition, the releasant addition amount, the releasant particle diameter, and the toner particle diameter of the obtained toner particles.

3 parts by weight of the same silica (Nippon Aerosil) and 0.5 parts by weight of the same titanium oxide (ISHIHARA SANGYO KAISHA) as used in Example 1 were added to 100 parts by weight of the capsulated toner particles described above. These materials were mixed and adhered by a Henschel mixer (MITSUI MINING) to obtain capsulated toner having a releasant content of 13%.

The fixing property test, durability test, and pulverizing property test were conducted on the obtained toner in the same manner as in Example 1. The obtained results are shown in Table 2 below.

Example 5

Capsulated toner having a volume-average particle diameter of 5.3 μm and a releasant content of 31% was obtained following the same procedures as in Example 2 except that the mixing amounts of the coloring agent-containing resin particle dispersion and releasant particle dispersion in the secondary particle formation step were changed as follows,

| | |
|---|---|
| Coloring agent-containing resin particle dispersion | 245 g |
| Releasant particle dispersion | 245 g |

and that the mixing amounts of the aggregated particle dispersion and emulsified particle dispersion in the capsulated particle formation step were changed as follows.

| | |
|---|---|
| Aggregated particle dispersion | 461 g |
| Coated resin particle dispersion | 39 g |

When the section of this toner particle was observed with a transmission electron microscope, the particle had a phase separation structure including a continuous phase made of the releasant and a disperse phase containing the binder resin and coloring agent. However, a region containing a large amount of the releasant was locally present.

Table 1 below shows the arrangement of the continuous phase, the presence/absence of the capsulation step, the binder resin composition, the releasant addition amount, the releasant particle diameter, and the toner particle diameter of the obtained toner particles.

The fixing property test, durability test, and pulverizing property test were conducted on the obtained toner in the same manner as in Example 1. The obtained results are shown in Table 2 below.

Example 6

Capsulated toner particles having a volume-average particle diameter of 5.3 μm and a releasant content of 4% were obtained following the same procedures as in Example 2 except that the mixing amounts of the coloring agent-containing resin particle dispersion and releasant particle dispersion in the secondary particle formation step were changed as follows,

| | |
|---|---|
| Coloring agent-containing resin particle dispersion | 447 g |
| Releasant particle dispersion | 43 g |

and that the mixing amounts of the aggregated particle dispersion and emulsified particle dispersion in the capsulated particle formation step were changed as follows.

| | |
|---|---|
| Aggregated particle dispersion | 452 g |
| Coated resin particle dispersion | 48 g |

Table 1 below shows the arrangement of the continuous phase, the presence/absence of the capsulation step, the binder resin composition, the releasant addition amount, the releasant particle diameter, and the toner particle diameter of the obtained toner particles.

The obtained capsulated toner particles were used to form toner following the same procedures as in Example 2.

When the section of this toner particle was observed with a transmission electron microscope, the releasant randomly dispersed in the binder resin, and no phase separation structure having the releasant as a continuous phase was found.

The fixing property test, durability test, and pulverizing property test were conducted on the obtained toner in the same manner as in Example 1. The obtained results are shown in Table 2 below.

Example 7

Capsulated toner particles having a volume-average particle diameter of 5.3 μm and a releasant content of 13% was obtained following the same procedures as in Example 2 except that the processing pressure of the wet-type high-pressure emulsifier was reduced to 100 MPa and the volume-average particle diameter of the releasant particles was changed to 350 nm in the releasant dispersion formation step.

When the section of this toner particle was observed with a transmission electron microscope, the releasant randomly dispersed in the binder resin, and a phase separation structure having the releasant as a continuous phase was difficult to find.

Table 1 below shows the arrangement of the continuous phase, the presence/absence of the capsulation step, the binder resin composition, the releasant addition amount, the releasant particle diameter, and the toner particle diameter of the obtained toner particles.

Toner was obtained by adding additives to 100 parts by weight of the toner particles following the same procedures as in Example 1.

The fixing property test, durability test, and pulverizing property test were conducted on the obtained toner in the same manner as in Example 1. The obtained results are shown in Table 2 below.

TABLE 1

| | Continuous phase | Capsulation step | Binder resin | Releasant addition amount (wt %) | Releasant particle diameter (nm) | Toner particle diameter (μm) |
|---|---|---|---|---|---|---|
| Example 1 | Releasant | Not performed | St-Ac | 15 | 102 | 5.1 |
| Comparative Example 1 | Resin | Not performed | St-Ac | 15 | 102 | 5.0 |
| Example 2 | Releasant | Performed | St-Ac | 13 | 102 | 5.3 |
| Comparative Example 2 | Resin | Performed | St-Ac | 13 | 102 | 5.2 |
| Example 3 | Releasant | Performed | St-Ac | 22 | 102 | 5.3 |
| Comparative Example 3 | Resin | Performed | St-Ac | 22 | 102 | 5.2 |
| Example 4 | Releasant | Performed | PEs | 13 | 98 | 5.7 |
| Comparative Example 4 | Resin | Performed | PEs | 13 | 98 | 5.7 |
| Example 5 | Releasant | Performed | St-Ac | 31 | 102 | 5.3 |
| Example 6 | Resin | Performed | St-Ac | 4 | 102 | 5.3 |
| Example 7 | Resin | Performed | St-Ac | 13 | 350 | 5.3 |

In Table 1, St-Ac indicates a styrene-acryl-based resin, and PEs indicates a polyester resin.

Comparison of the toner particles of Examples 1 to 4 with the toner particles of Comparative Examples 1 to 4 shows that the non-offset region improved on both the low- and high-temperature sides in each of Examples 1 to 4, although the formulations were the same. This is presumably because upon heating the toner behaved like an emulsion adhesive having the releasant as a medium, so the paper sheet and the image strongly adhered by the anchor effect. The toner of Example 2 in which capsulation was performed was slightly worse than that of Example 1. This is probably because the resin as a shell interfered with the adhesion of the resin particles inside the toner particles to the paper sheet. When compared to Example 2, Examples 3 and 5 improved on both the low- and high-temperature sides because the releasant amounts were increased. On the other hand, in Example 6 in which the releasant addition amount was small, no releasant continuous phase of the present invention was formed, and the fixing properties were slightly worse than those of the other examples. Likewise, the fixing properties of the toner of Example 7 were slightly inferior to those of Example 2. Example 4 was better than Example 2 since polyester was used as the internal resin of the toner particle.

TABLE 2

| | Non-offset region (° C.) | Pulverizing properties | Number of sheets when filming occurred |
|---|---|---|---|
| Example 1 | 130 to 210 | Reduced by 1.5 μm | 45000 sheets |
| Comparative Example 1 | 140 to 190 | Reduced by 1.1 μm | 45000 sheets |
| Example 2 | 135 to 200 | No change | None |
| Comparative Example 2 | 145 to 195 | No change | None |
| Example 3 | 130 to 210 | Reduced by 0.2 μm | None |
| Comparative Example 3 | 135 to 200 | Reduced by 0.2 μm | None |
| Example 4 | 125 to 190 | No change | None |
| Comparative Example 4 | 130 to 185 | No change | None |
| Example 5 | 130 to 220 | Reduced by 1.8 μm | 40000 sheets |
| Example 6 | 135 to 180 | No change | None |
| Example 7 | 145 to 195 | No change | None |

As shown in Table 2 below, the results of the durability test and pulverizing property test of Example 1 and Comparative Example 1 were substantially the same. This is presumably because the releasant was present on the toner particle surface in each of Example 1 and Comparative Example 1. In contrast, the capsulated toner particles except for Example 5 had no releasant on the toner particle surface, so generally good results were obtained. Example 5 tends to be inferior in durability since the releasant content was large.

Additional advantages and modifications will readily occur to those skilled in the art. Therefore, the invention in its broader aspects is not limited to the specific details and representative embodiments shown and described herein. Accordingly, various modifications may be made without departing from the spirit and scope of the general inventive concept as defined by the appended claims and their equivalents.

What is claimed is:

1. A developing agent comprising a toner particle having a plurality of resin particles containing a binder resin and coloring agent, and a continuous releasant phase which is present between said plurality of resin particles, and coats on said plurality of resin particles.

2. A developing agent according to claim 1, wherein the toner particle is obtained by:

i) a secondary particle formation step of forming secondary particles by adhering the releasant to surfaces of primary particles which carry the coloring agent and contain the binder resin;

ii) an aggregation step of aggregating the secondary particles obtained in the secondary particle formation step; and iii) a step of heating an aggregate obtained in the aggregation step.

3. A developing agent according to claim 2, wherein the primary particles have a particle diameter of 0.1 to 3.0 μm.

4. A developing agent according to claim 2, wherein the releasant is made of particles having a particle diameter not more than ½ the particle diameter of the primary particles.

5. A developing agent according to claim 2, wherein the secondary particle formation step further comprises a step of heating the secondary particles to which the releasant particles are adhered.

6. A developing agent according to claim 2, wherein in the aggregation step, the aggregated secondary particles are heated, and a coating resin material is applied to the heated secondary particles to form an aggregate coated with the coating resin material.

7. A developing agent according to claim 6, wherein the binder resin and the coating resin material contain the same resin component.

8. A developing agent according to claim 2, wherein in the aggregation step, a coating resin material is applied to the aggregated secondary particles to form an aggregate coated with the coating resin material.

9. A developing agent according to claim 8, wherein the binder resin and the coating resin material contain the same resin component.

10. A developing agent manufacturing method comprising: i) a secondary particle formation step of forming secondary particles by adhering releasant particles to surfaces of primary particles which carry a coloring agent and contain a binder resin; ii) an aggregation step of aggregating the secondary particles obtained in the secondary particle formation step; and iii) a step of forming a toner particle by heating an aggregate obtained in the aggregation step.

11. A method according to claim 10, wherein the primary particles have a particle diameter of 0.1 to 3.0 μm.

12. A method according to claim 10, wherein the releasant particles have a particle diameter not more than ½ the particle diameter of the primary particles.

13. A method according to claim 10, wherein the secondary particle formation step further comprises a step of heating the secondary particles to which the releasant particles are adhered.

14. A method according to claim 10, wherein the aggregation step further comprises steps of: heating the aggregated secondary particles; and applying a coating resin material to the heated secondary particles to form an aggregate coated with the coating resin material.

15. A method according to claim 14, wherein the binder resin and the coating resin material contain the same resin component.

16. A method according to claim 10, wherein the aggregation step further comprises a step of applying a coating resin material to the aggregated secondary particles to form an aggregate coated with the coating resin material.

17. A method according to claim 16, wherein the binder resin and the coating resin contain the same resin component.

18. A developing agent according to claim 8, wherein the binder resin and the coating resin material contain different resin components.

19. A method according to claim 14, wherein the binder resin and the coating resin material contain different resin components.

20. A method according to claim 16, wherein the binder resin and the coating resin material contain different resin components.

* * * * *